US008622121B2

(12) United States Patent
Udipi et al.

(10) Patent No.: US 8,622,121 B2
(45) Date of Patent: Jan. 7, 2014

(54) REINFORCED FRAC TUBING HEAD

(75) Inventors: Mahesha Udipi, Houston, TX (US); Alfredo Olvera, Houston, TX (US); Jim Hwang, Houston, TX (US); Jean Brunjes, Missouri City, TX (US); Eugene A. Borak, Jr., Tomball, TX (US)

(73) Assignee: Vetco Gray Inc., Houston, TX (US)

( * ) Notice: Subject to any disclaimer, the term of this patent is extended or adjusted under 35 U.S.C. 154(b) by 329 days.

(21) Appl. No.: 13/025,021

(22) Filed: Feb. 10, 2011

(65) Prior Publication Data

US 2012/0205111 A1 Aug. 16, 2012

(51) Int. Cl.
*E21B 33/03* (2006.01)

(52) U.S. Cl.
USPC ..... 166/75.13; 166/97.1

(58) Field of Classification Search
USPC ..... 166/75.13, 97.1, 368; 285/368, 405, 285/411, 412
See application file for complete search history.

(56) References Cited

U.S. PATENT DOCUMENTS

| | | | |
|---|---|---|---|
| 5,341,885 | A | 8/1994 | Bridges |
| 5,540,282 | A | 7/1996 | Dallas |
| 6,179,053 | B1 | 1/2001 | Dallas |
| 6,289,993 | B1 | 9/2001 | Dallas |
| 6,364,024 | B1 | 4/2002 | Dallas |
| 6,470,965 | B1 | 10/2002 | Winzer |
| 6,516,861 | B2 | 2/2003 | Allen |
| 6,666,266 | B2 | 12/2003 | Starr et al. |
| 6,817,423 | B2 | 11/2004 | Dallas |
| 7,055,632 | B2 | 6/2006 | Dallas |
| 7,066,269 | B2 | 6/2006 | Dallas et al. |
| 7,069,987 | B2 | 7/2006 | Kwasniewski et al. |
| 7,308,934 | B2 | 12/2007 | Swagerty et al. |
| 7,614,448 | B2 | 11/2009 | Swagerty et al. |
| 2003/0205385 | A1 | 11/2003 | Duhn et al. |
| 2006/0017287 | A1 | 1/2006 | Milberger |
| 2007/0102926 | A1 * | 5/2007 | Magnier et al. ..... 285/368 |
| 2009/0211749 | A1 | 8/2009 | Nguyen et al. |

FOREIGN PATENT DOCUMENTS

| | | | |
|---|---|---|---|
| CA | 2195118 | A1 | 7/1998 |
| CA | 2276973 | A1 | 3/2000 |
| EP | 0117417 | A1 | 9/1984 |
| WO | 2009088674 | A2 | 7/2009 |

OTHER PUBLICATIONS

GB Search Report dated Mar. 29, 2012 from corresponding Application No. GB1202196.0.

* cited by examiner

*Primary Examiner* — Giovanna Wright
*Assistant Examiner* — Richard Alker
(74) *Attorney, Agent, or Firm* — Bracewell & Giuliani LLP

(57) ABSTRACT

A reinforced wellhead member for use during fracing operations. The wellhead member is preloaded at a flange section by creating compressive stresses via a ring that interacts with a tightening nut on a bolt. The bolt is rigidly attached to an adapter which may also be modified to create stresses on the flange of the wellhead member. The induced stresses counter the tensile stresses experienced by the flange during fracing operations, allowing a standard wellhead member to be utilized.

15 Claims, 3 Drawing Sheets

REINFORCED FRAC TUBING HEAD

FIELD OF THE INVENTION

The present invention relates in general to an improved wellbore fracturing system, and in particular to an improved wellhead fracture isolation system.

BACKGROUND OF THE INVENTION

One type of treatment for an oil or gas well is referred to as well fracturing or a well "frac." Typically an operator connects an adapter to the upper end of a wellhead member such as a tubing head and pumps a liquid at a very high pressure down the well to create fractures in the earth formation. The operator will also then disburse beads or other proppant material in the fracturing fluid to enter the cracks to keep them open after the high pressure is removed. This type of operation is particularly useful for earth formations that have low permeability but adequate porosity and contain hydrocarbons, as the hydrocarbons can flow more easily through the fractures created in the earth formation.

The pressure employed during the frac operation may be many times the natural earth formation pressure that ordinarily would exist. For example, during a frac operation the operator might pump the fluid at a pressure of 8,000 to 9,000 psi, whereas the normal pressure in the wellhead might be only a few hundred to a few thousand psi. Because of this, the body of the wellhead and its associated valves typically may be rated to a pressure that is much lower than what is desired for frac operations. While this is sufficient to contain the normal well formation pressures, it is not enough for the fluid pressure used to fracture the earth formation. Thus, the wellhead and associated valves may be damaged during frac operations.

Moreover, because of the proppant material contained in the frac fluid, the frac fluid can be very abrasive and damaging to parts of the wellhead. To allow the operator to use a pressure greater than the rated capacity of the wellhead seals (including the various valves associated with the wellhead) and to protect against erosion resulting from the frac fluid being pumped at high pressure and volume into the well, the operator may employ an isolation sleeve to isolate these sensitive portions of the wellhead from the frac fluid. An isolation sleeve seals between an adapter above the wellhead and the casing or tubing extending into the well. The sleeve isolates the high pressure, abrasive fracturing fluid from those portions of the wellhead that are most susceptible to damage from the high pressures and abrasive fluids used in well fracturing operations. However, even with the use of an isolation sleeve, unacceptable levels of tensile stress may be induced in the hub section of the wellhead. It is desirable to reduce these tensile stresses in the wellhead.

SUMMARY OF THE INVENTION

An isolation sleeve is carried by a running tool or an adapter assembly for insertion into the bore of a wellhead or tubing head. The wellhead is the surface termination of a wellbore and typically includes a casing head for installing casing hangers during the well construction phase and (when the well will be produced through production tubing) a tubing head mounted atop the casing head for hanging the production tubing for the production phase of the well. The casing in a well is cemented in place in the hole that is drilled. The fluids from the well may be produced through the casing or through production tubing that runs inside the casing from the wellhead to the downhole formation from which the fluids are being produced.

The isolation sleeve may be configured to be installed and retrieved from the wellhead by a running/retrieval tool. The tool can be lowered through a double studded adapter connected to the tubing head and frac valve if installed. Lockdown screws may be used to maintain the isolation sleeve within the tubing head during fracturing operations.

A washer and split ring assembly is utilized at a hub or flange section at an upper portion of the tubing head. The washer is axially located between the flange and nuts threaded onto the studs or bolts of the adapter, which run through the flange. The ring is radially located between the washer and the tubing head body. The ring may have a tapered outer shoulder that contacts a corresponding shoulder on the washer such that when the nut is tightened, at least a portion of the tightening force is transmitted via the washer and ring to the flange of the tubing head. The force induces a compressive stress on the flange that advantageously counters the tensile stresses experienced by the flange section during fracing operations.

The interface between the adapter plate and the tubing head flange may also be modified to counter the tensile stresses experienced during fracing operations. An inner shoulder may be formed on a lower end of the adapter plate that protrudes further downward than an outer shoulder of the adapter plate. Both inner and outer shoulders contact the upper end of the flange of the tubing head when the adapter is fully made up with the flange. During tightening of the adapter bolts, the inner shoulder will first contact the upper end of the flange. Because the inner shoulder is radially disposed a distance "r" from the bolt axis, a moment is advantageously created that acts as a preload that must be overcome by the tensile stresses. At final bolt torque, the outer shoulder contacts the flange to serve as a stop and prevent further movement of the adapter.

These features advantageously counter the unacceptable tensile stresses induced on the flange of a tubing head during well fracturing operations.

DETAILED DESCRIPTION OF THE INVENTION

Figure 1:
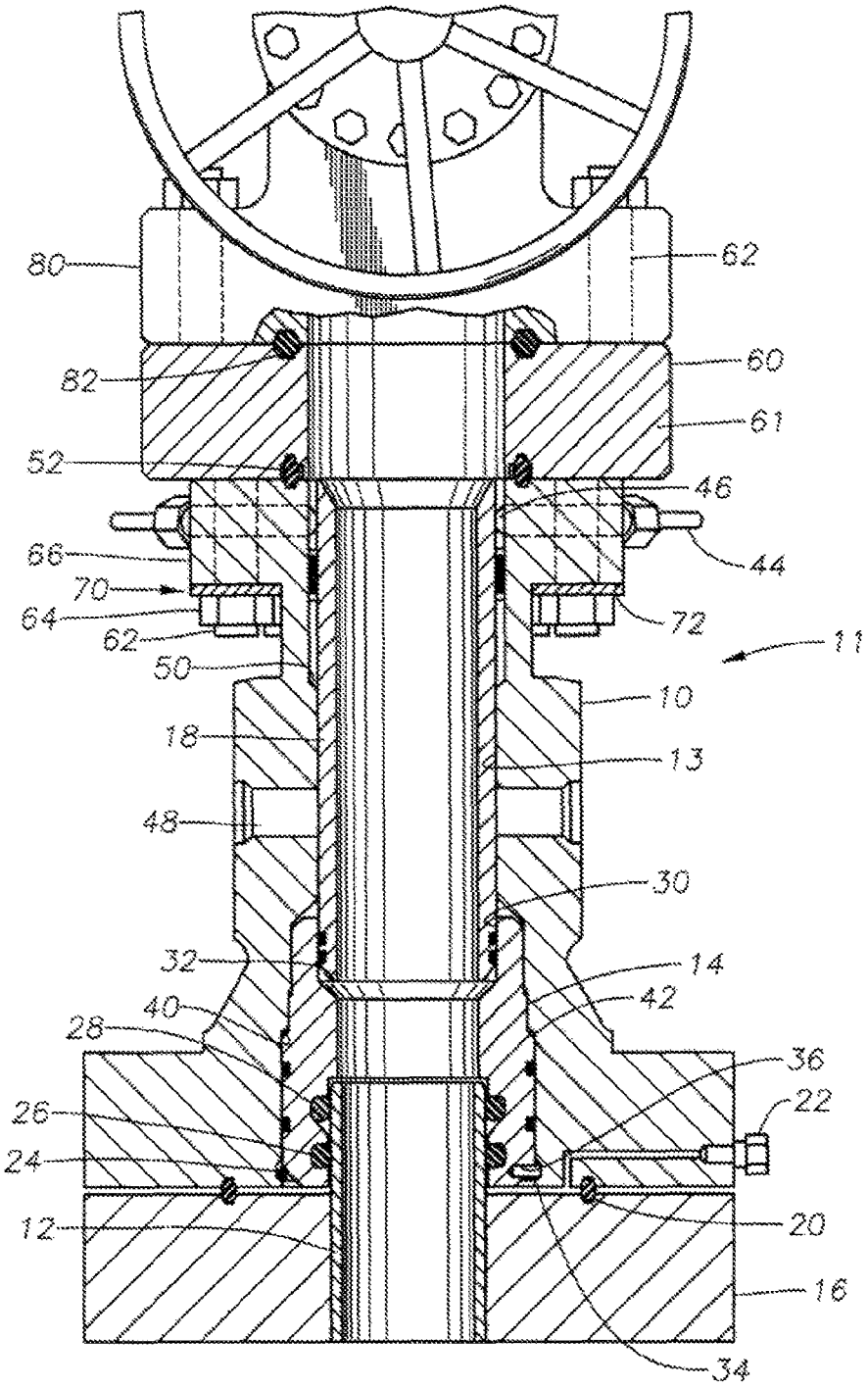
FIG. 1 is a sectional view illustrating a well fracturing assembly including an isolation sleeve connected to a tubing head for a frac operation, the well fracturing assembly being constructed in accordance with one embodiment of the invention.

FIG. 1 shows an embodiment of a wellhead frac assembly 11 used in a frac operation. The wellhead or tubing head 10 may be rated for a working pressure of 5000 psi and has a bore 13 extending vertically through it (the lower portion of the wellhead is not shown). Tubing head 10 is a spool like member with a flange on its lower end that projects radially outward. In this embodiment, the lower end of the tubing head 10 fits over an upper end of production casing 12, an annular packoff bushing 14 coaxially located within the lower end of the tubing head 10 provides a sealed connection between the casing 12 and tubing head 10. The production casing 12 may protrude from a casing head 16 that can support the tubing head 10. In this embodiment, the tubing head 10 is mounted on top of the casing head 16. A gasket 20 provides a seal between the tubing head 10 and the casing head 16. Potential leaks at the gasket 20 can be detected through a test port 22 on the tubing head 10 shown in communication with the annular space interior to the gasket 20. In this embodiment, the packoff bushing 14 has an outer profile that corresponds to an interior recess in the bottom of the tubing head 10. The packoff bushing 14 can be locked in place within the tubing head by an annular snap ring 24 and sealed against the production casing 12 with an annular o-ring seal 26. An annular o-ring seal 28 with anti-extrusion ring can be installed on the low pressure side of the o-ring seal 26 to prevent elastomer extrusion into a clearance gap between the production casing 12 and the packoff bushing 14.

An isolation sleeve 18 is shown installed within the bore 13 of the tubing head 10 to protect the tubing head 10 from the high pressure and abrasive fluids imposed during a well fracturing operation. The pressure during fracturing operations can be significantly higher than the rating of the wellhead 10 and associated components such as valves. Thus, isolation sleeve 18 and packoff bushing 14 are rated for pressures above 5000 psi normal working pressure. A lower end of isolation sleeve 18 may be inserted into an upper receptacle 30 on an upper end of the packoff bushing 14 having an upward facing shoulder 32. An anti-rotation key 34 located on the lower end of packoff bushing 14 that interferes with a slot 36 formed in tubing head 10 to prevent the packoff bushing 14 from rotating if the isolation sleeve 18 is installed within the packoff bushing 14 by threading or a Back Pressure Valve (BPV) (not shown) is made or removed from the packoff bushing 14. The bore of the packoff bushing 14 below the shoulder 32 may be prepared with a threaded profile to receive a BPV. Further, a downward facing shoulder 40 located in the recess of the wellhead member 10 interferes with an upward facing shoulder 42 located on the outer surface of the packoff bushing 14 to limit the upward movement of the packoff bushing 14 within the wellhead member 10. In this example, lockdown screws 44 engage a groove 46 formed on an exterior surface of the isolation sleeve 18 to maintain the isolation sleeve 18 in place during fracturing operations. The tapered shoulder 32 prevents the lower end of the isolation sleeve 18 from coming into contact with the top of the production casing 12 to thereby create a gap between the two well components.

Continuing to refer to FIG. 1, in this embodiment tubing head 10 can have one or more production outlets 48 located at a point above production casing 12 and extending laterally from the tubing head 10 for the flow of well fluid during production. Alternatively, outlets 48 could be used as instrumentation ports or outlets for leak detection. Further, tubing head 10 can have a tapered shoulder 50 formed inside the bore of tubing head 10 that can support a tubing hanger (not shown) and function to transfer load to the tubing head 10 if desired. Such a tubing hanger could be held in place within tubing head 10 by the lockdown screws 44.

A gasket 52 provides a seal at the interface between a flange 66 of the tubing head 10 and an annular double-studded adapter (DSA) 60 having a bore diameter that can accommodate the outer diameter of the isolation sleeve 18. The DSA 60 comprises a plate 61 and may be provided with test ports (not shown) to allow detection of potential leaks. A set of threaded studs 62 each secure to threaded holes of the DSA 60, and protrude upward and downward from DSA 60. The studs 62 projecting downward may be of a different size than studs 62 projection upward. The lower ends of studs 62 extends through holes in an external flange 66 of tubing head 10 and secure DSA 60 to tubing head 10 with nuts 64. A washer and reinforcement ring assembly 70 may be located between the nut 64 and a lower surface 72 of the flange 66 to provide a compressive load that counters tensile stresses experienced at the flange 66 during fracing operations. The washer and ring assembly 70 will be discussed in more detail in a subsequent section. The upper studs or bolts 62 of the DSA 60 allow additional equipment, such as a frac valve 80, to be mounted to an upper portion of the DSA 60. An annular gasket 82 may be utilized at the interface between a flange of the frac valve 80 and the DSA 60.

Figure 2:
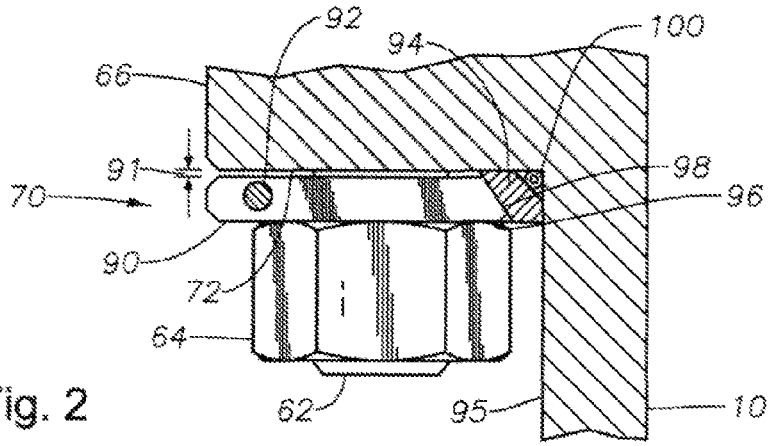
FIG. 2 is a partial sectional view of a portion of the assembly in FIG. 1 showing a washer and split ring installed on the tubing head, in accordance with one embodiment of the invention.
Figure 3:
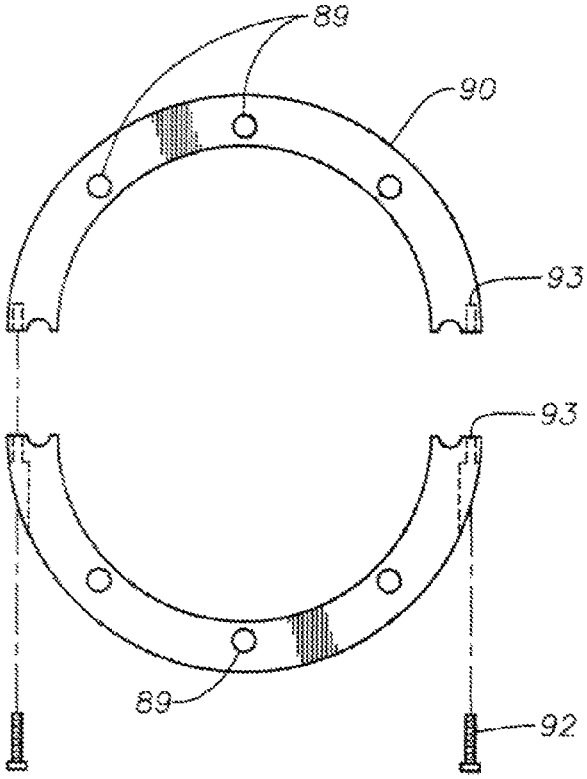
FIG. 3 is a top view of an embodiment of a segmented washer, in accordance with one embodiment of the invention.
Figure 4:
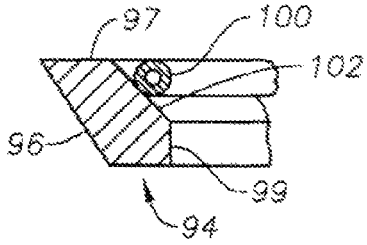
FIG. 4 is a sectional view of the spit ring with a junk ring from FIG. 2, in accordance with one embodiment of the invention.

Referring to FIG. 2, a partial sectional view of a portion of the washer and split ring assembly 70 of FIG. 1 is shown in more detail. A washer 90 is installed between the nut 64 and the flange 66. In this embodiment the washer 90 is segmented and has two semi-circular halves that are fastened to each other by screws 92 that correspond to passages 93 formed at joining ends of the washer 90, as shown in FIG. 3. Holes 89 are formed on the washer 90 that correspond to the bolts 62 to allow the bolts 62 to pass through. When installed, a gap 91 exists between a top end of the washer 90 and the lower surface 72 of the flange 66 and remains even after the flange 66 is fully made up. The washer 90 has a tapered shoulder 98 formed on an interior diameter of the washer 90, which contacts a corresponding shoulder 96 (FIG. 4) formed on an outer diameter of a reinforcement ring or wedge ring 94. The wedge ring 94 may be segmented and is radially located between the washer 90 and an outer surface 95 of the tubing head 10. Surfaces 97, 99 of the wedge ring 94 are orthogonal to each other and contact the lower surface 72 of the flange 66 and the outer surface 95 of the tubing head 10, respectively. Further, a junk ring 100, which may be composed of metal, is wedged between the tubing head 10 and a tapered shoulder 102 formed on an inner diameter of the wedge ring 94. When the nut 64 is tightened onto the bolt 62 and contacts a lower portion of the washer 90, at least a portion of the tightening force is transmitted via the washer 90, to the ring 94, and to the flange 66 of the tubing head 10. The junk ring 100 may be deformed during tightening of the nuts 64 to provide a better fit. A radial inward component of the force is applied to the flange 66 due to the correspondingly tapered shoulders 98, 96 on the washer 90 and wedge ring 94. This radial, inward component of the force induces a compressive stress on the flange 66 that advantageously counters tensile stresses that may be experienced by the flange 66 section during fracing operations. The washer 90 and wedge ring 94 provide reinforcement to the flange 66, allowing the use of a standard low pressure tubing head 10 during fracing operations rather than a more expensive tubing head with a higher pressure rating.

In general, during fracing operations, pressure from the high pressure fracturing pushes against frac valve 80 (FIG. 1) and places tensions on the upward facing bolts 62. Tension in the bolts 62 pulls on the outer radius of the flange 66 of the tubing head 10 and "bends" it upward. The torque due to this tension is represented by a curved arrow, TF, under the bolts 62 (see FIG. 5) that is shown clockwise if on the left bolt 62 and would be counter clockwise if on a right bolt 62. The prestress disclosed in this application induces a prestress torque, TPS, directed opposite to the torque, TF, in the flange 66, which is demonstrated by an oppositely oriented arrow adjacent the plate 61. Thus, under normal pressure, the plate 61 and flange 66 would be prestressed, due to TPS, but during the high pressure fracturing operations, the torque from the tension in the bolts 63, TF, cancels out the prestress, TPS.

Figure 5:
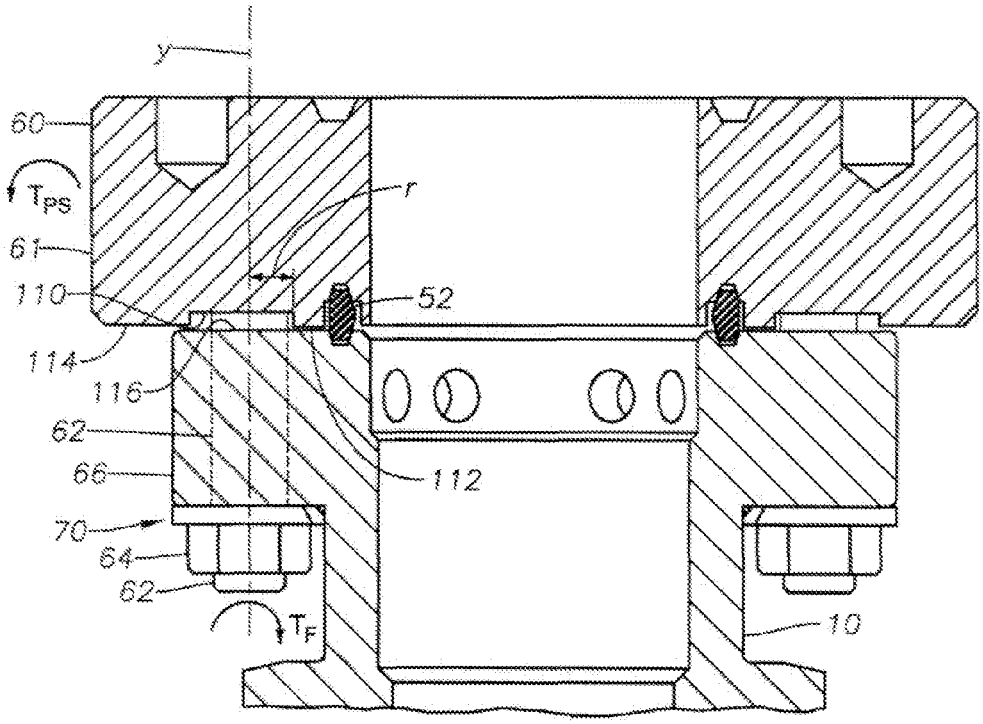
FIG. 5 is a partial sectional view of the adapter and flange interface from FIG. 1, in accordance with one embodiment of the invention.
Figure 6:
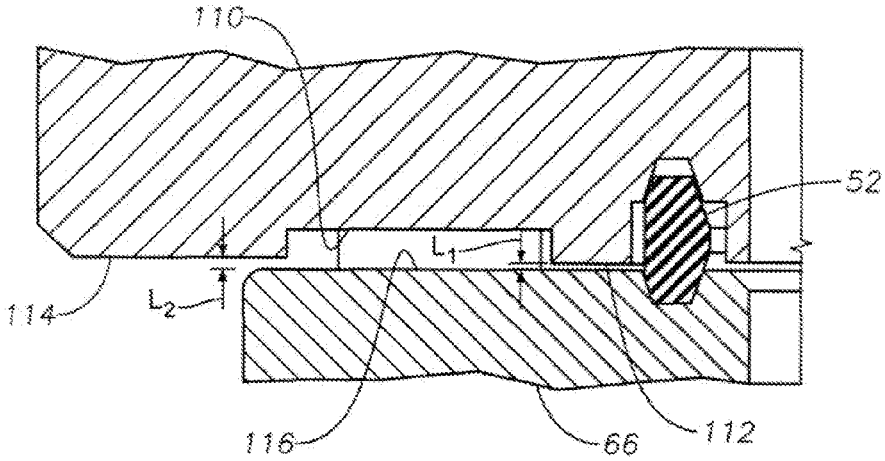
FIG. 6 is an enlarged partial sectional view of the adapter and flange interface from FIG. 5, in accordance with one embodiment of the invention.

In another embodiment of the invention, illustrated in FIGS. 5 and 6, the plate 61 of the DSA 60 is modified to provide reinforcement to the flange 66 to counter the tensile stresses experienced during fracing operations. An annular recess 110 is formed on a lower surface of the DSA plate 61. A centerline of the recess 110 is offset from a bolt axis y and defines an inner shoulder 112 formed on the lower surface of the adapter plate 61 between the recess 110 and bore. The recess 110 also defines an outer shoulder 114 on the lower surface of the adapter plate 61 between the recess 110 and outer diameter of the plate 61. The inner shoulder 112 protrudes further downward than the outer shoulder 114 such that a gap $L_1$ between the inner shoulder 112 and a top surface 116 of the flange 66 is smaller than a gap $L_2$ between the outer shoulder 114 and the top surface 116. Both gaps $L_1$ and $L_2$ are closed when the inner and outer shoulders 112, 114 contact the top surface 116 of the flange 66 when the adapter 60 is fully made up with the flange 66. During tightening of nuts 64 on the adapter bolts 62, the inner shoulder 112 will first contact the top surface 116 of the flange 66. Because the inner shoulder 112 is radially disposed a distance "r" from the bolt axis y, a moment is advantageously created that acts as a preload that must be overcome by the tensile stresses. At final bolt torque, the outer shoulder 114 contacts the top surface 116 of the flange 66 to serve as a stop and prevent further movement of the adapter 60. The modification to the DSA 60 described in this embodiment may be used separate from or together with the features described in the first embodiment.

While the invention has been shown in only a few of its forms, it should be apparent to those skilled in the art that it is not so limited but is susceptible to various changes without departing from the scope of the invention.

The invention claimed is:

1. A wellhead apparatus, comprising:

a wellhead member having a vertical bore for receiving an upper end of a string of conduit extending into a well;

a sleeve carried within the bore of the wellhead member, wherein the sleeve isolates the bore of the wellhead member from a high pressure fluid injected into the sleeve;

a flange formed on an upper end of the wellhead member, the flange having an upper surface and a lower surface, the flange having a passage extending therethrough from the upper to the lower surface for receiving a threaded bolt;

an annular wedge ring located adjacent the lower surface of the flange and having a downward facing tapered shoulder formed on an outer diameter so that when a nut is tightened onto the bolt, a radial inward component of a tightening force on the bolt is applied through the tapered shoulder of the ring and to the flange, the radial component of the force countering tensile stress induced on the flange by the high pressure fluid injected into the sleeve; and a segmented washer installed between the nut on the bolt and the lower surface of the flange, wherein a gap is maintained between the washer and the lower surface of the flange when the flange is made up and the nut is tightened on the bolt, wherein the washer is comprised of two semi-circular halves that are fastened to each other by screws that correspond to passages formed at joining ends of the washer, and wherein the washer has a tapered shoulder formed on an interior diameter of the washer that is in contact with the correspondingly tapered shoulder formed on the outer diameter of the wedge ring so that the tightening force from the nut is transmitted from the washer, to the tapered shoulder of the washer, to the tapered shoulder of the wedge ring, such that a radial inward component of the tightening force is applied to the flange.

2. The apparatus according to claim 1, further comprising:

an adapter mounted and sealed to the upper surface of the flange, the adapter having an upper surface and a lower surface and having a bore that is coaxial with the bore of the wellhead member;

an outer shoulder formed on the lower surface of the adapter; and an inner shoulder formed on the lower surface of the adapter and located radially inward from the outer shoulder, the inner shoulder protruding further downward than the outer shoulder such the inner shoulder contacts the upper surface of the flange of the wellhead member before the outer shoulder when the nut is tightened on the bolt during make up of the adapter to the flange.

3. The apparatus according to claim 2, wherein the inner shoulder is radially offset from an axis of the bolt so that when the inner shoulder contacts the upper surface of the flange, a moment is created that increases as the nut is tightened on the bolt and counters the tensile stresses induced on the flange by the high pressure fluid injected into the sleeve.

4. The apparatus according to claim 3, wherein the outer shoulder of the adapter contacts the upper surface of the flange to further prevent movement of the adapter when the nut is tightened on the bolt to a final bolt torque.

5. The apparatus according to claim 4, wherein:

the adapter comprises a plate that overlies the flange on an upper end of the wellhead member, the flange on the wellhead member containing a bolt hole pattern that includes the passage extending through the flange;

a plurality of threaded bolts including the threaded bolt received in the passage extending through the flange, the plurality of threaded bolts rigidly mounted in the plate of the adapter, the bolts extending downward from the plate and through the bolt hole pattern of the wellhead member to secure the adapter to the wellhead member, the bolts extending upward from the plate of the adapter for insertion into a bolt hole pattern of a fluid injection valve.

6. An apparatus for reinforcing a wellhead apparatus, comprising:

a flange formed on an upper end of a wellhead member having a vertical bore for receiving an upper end of a string of conduit extending into a well, the flange having an upper surface and a lower surface, the flange having a passage extending therethrough from the upper to the lower surface for receiving a bolt, a sleeve carried within the bore of the wellhead member, wherein the sleeve isolates the bore of the wellhead member from a high pressure fluid injected into the sleeve;

an annular wedge ring located adjacent the lower surface of the flange and having a downward facing tapered shoulder formed on an outer diameter so that when a nut is tightened onto the bolt, a radial inward component of a tightening force on the bolt is applied through the tapered shoulder of the ring and to the flange, the radial component of the force countering tensile stress induced on the flange by the high pressure fluid injected into the sleeve; and a segmented washer installed between the nut on the bolt and the lower surface of the flange, wherein a gap is maintained between the washer and the lower surface of the flange when the flange is made up and the nut is tightened on the bolt, wherein the washer is comprised of two semi-circular halves that are fastened to each other by screws that correspond to passages formed at joining ends of the washer, and wherein the washer has a tapered shoulder formed on an interior diameter of the washer that is in contact with the correspondingly tapered shoulder formed on the outer diameter of the wedge ring so that the tightening force from the nut is transmitted from the washer, to the tapered shoulder of the washer, to the tapered shoulder of the wedge ring, such that a radial inward component of the tightening force is applied to the flange.

7. The apparatus according to claim 6, further comprising:

an adapter mounted and sealed to the upper surface of the flange, the adapter having an upper surface and a lower surface and having a bore that is coaxial with the bore of the wellhead member;

an outer shoulder formed on the lower surface of the adapter; and an inner shoulder formed on the lower surface of the adapter and located radially inward from the outer shoulder, the inner shoulder protruding further downward than the outer shoulder such the inner shoulder contacts the upper surface of the flange of the wellhead member before the outer shoulder when the nut is tightened on the bolt during make up of the adapter to the flange.

8. The apparatus according to claim 7, wherein the inner shoulder is radially offset from an axis of the bolt so that when the inner shoulder contacts the upper surface of the flange, a moment is created that increases as the nut is tightened on the bolt and counters the tensile stresses induced on the flange by the high pressure fluid injected into the sleeve.

9. The apparatus according to claim 8, wherein the outer shoulder of the adapter contacts the upper surface of the flange to further prevent movement of the adapter when the nut is tightened on the bolt to a final bolt torque.

10. The apparatus according to claim 9, wherein:

the adapter comprises a plate that overlies the flange on an upper end of the wellhead member, the flange on the wellhead member containing a bolt hole pattern that includes the passage extending through the flange;

a plurality of threaded studs rigidly mounted in the plate of the adapter, the studs extending downward from the plate and through the bolt hole pattern of the flange formed on the upper end of the wellhead member to secure the adapter to the wellhead member, the studs extending upward from the plate of the adapter for insertion into a bolt hole pattern of a fluid injection valve.

11. A method for reinforcing an apparatus in a well, comprising:

installing a wellhead member having a vertical bore for receiving an upper end of a string of conduit extending into the well, the wellhead member having a flange with a bolt hole pattern located at an upper end of the wellhead member;

running and installing a sleeve into the bore of the wellhead member, wherein the sleeve isolates the bore of the wellhead member from a high pressure fluid injected into the sleeve;

installing an annular wedge ring adjacent to a lower surface of the flange formed on the upper end of the wellhead member; wherein, the wedge ring has a downward facing tapered shoulder formed on an outer diameter so that when a nut is tightened onto a bolt in one of the bolt holes, a radial inward component of a tightening force on the bolt is applied through the tapered shoulder of the ring and to the flange, the radial component of the force countering tensile stress induced on the flange by the high pressure fluid injected into the sleeve; and installing a segmented washer between the nut on the bolt and the lower surface of the flange, wherein, a gap is maintained between the washer and the lower surface of the flange when the flange is made up and the nut is tightened on the bolt;

the washer is comprised of two semi-circular halves that are fastened to each other by screws that correspond to passages formed at joining ends of the washer; and the washer has a tapered shoulder formed on an interior diameter of the washer that is in contact with the correspondingly tapered shoulder formed on the outer diameter of the wedge ring so that the tightening force from the nut is transmitted from the washer, to the tapered shoulder of the washer, to the tapered shoulder of the wedge ring, such that a radial inward component of the tightening force is applied to the flange.

12. The method according to claim 11, further comprising installing an adapter mounted and sealed to the upper surface of the flange, the adapter having an upper surface and a lower surface and having a bore that is coaxial with the bore of the wellhead member;

wherein, an outer shoulder is formed on the lower surface of the adapter; and an inner shoulder formed on the lower surface of the adapter and located radially inward from the outer shoulder, the inner shoulder protruding further downward than the outer shoulder such the inner shoulder contact the upper surface of the flange of the wellhead member before the outer shoulder when the nut is tightened on the bolt during make up of the adapter to the flange.

13. The method according to claim 12, wherein the inner shoulder is radially offset from an axis of the bolt so that when the inner shoulder contacts the top surface of the flange, a moment is created that increases as the nut is tightened on the bolt and counters the tensile stresses induced on the flange by the high pressure fluid injected into the sleeve.

14. The method according to claim 13, wherein the outer shoulder of the adapter contacts the upper surface of the flange to further prevent movement of the adapter when the nut is tightened on the bolt to a final bolt torque.

15. The method according to claim 14, further comprising mounting a fluid injection valve to the upper end of the adapter, wherein, the adapter comprises a plate that overlies the flange on an upper end of the wellhead member; and a plurality of threaded studs are rigidly mounted to the plate of the adapter, the studs extending downward from the plate and through the bolt hole pattern of the wellhead member to secure the adapter to the wellhead member, the studs extending upward from the plate of the adapter for insertion into a bolt hole pattern of a fluid injection valve.

* * * * *